United States Patent [19]

Stokes

[11] 4,426,080

[45] Jan. 17, 1984

[54] LIGHTER-THAN-AIR BALL GAME APPARATUS

[76] Inventor: Edward M. Stokes, Stillmeadow, Coniston, Nr. Hull, North Humberside HU11 411, England

[21] Appl. No.: 281,538

[22] Filed: Jul. 8, 1981

[51] Int. Cl.[3] ..... A63B 67/00

[52] U.S. Cl. ..... 273/118 A; 273/127 D; 273/375; 273/411

[58] Field of Search ..... 273/118 R, 118 A, 371, 273/374, 375, 376, 411, 127 R, 127 D; 46/87

[56] References Cited

U.S. PATENT DOCUMENTS

| | | | |
|---|---|---|---|
| 726,833 | 4/1903 | Williamson | 273/398 |
| 1,556,046 | 10/1925 | Taylor | 273/411 |
| 1,958,892 | 5/1934 | Hill | 273/357 |
| 2,330,771 | 9/1943 | Williams et al. | 273/118 A X |
| 3,254,433 | 6/1966 | Saile et al. | 273/374 X |
| 3,880,427 | 4/1975 | Bingham | 273/411 X |
| 3,989,246 | 11/1976 | Brown et al. | 273/371 X |
| 4,307,537 | 12/1981 | Bergmann | 46/87 |

FOREIGN PATENT DOCUMENTS

| | | | |
|---|---|---|---|
| 495393 | 8/1950 | Belgium | 273/118 A |

*Primary Examiner*—Anton O. Oechsle
*Attorney, Agent, or Firm*—William A. Drucker

[57] ABSTRACT

Apparatus for playing an adversary ball game by two players or teams of players has a roof, such as a lightweight mesh, which is supported above the ground to define a playing area below it. At each of two opposite ends of the playing area there is provided a goal which can be contacted by a ball directed towards it by a player. The ball is lighter-than-air and is free to run along the underside of the roof, as directed or struck by the player's hand or a stick, bat, or a striker mounted on a vehicle or on a horse carrying the player.

7 Claims, 3 Drawing Figures

LIGHTER-THAN-AIR BALL GAME APPARATUS

Figure 1:
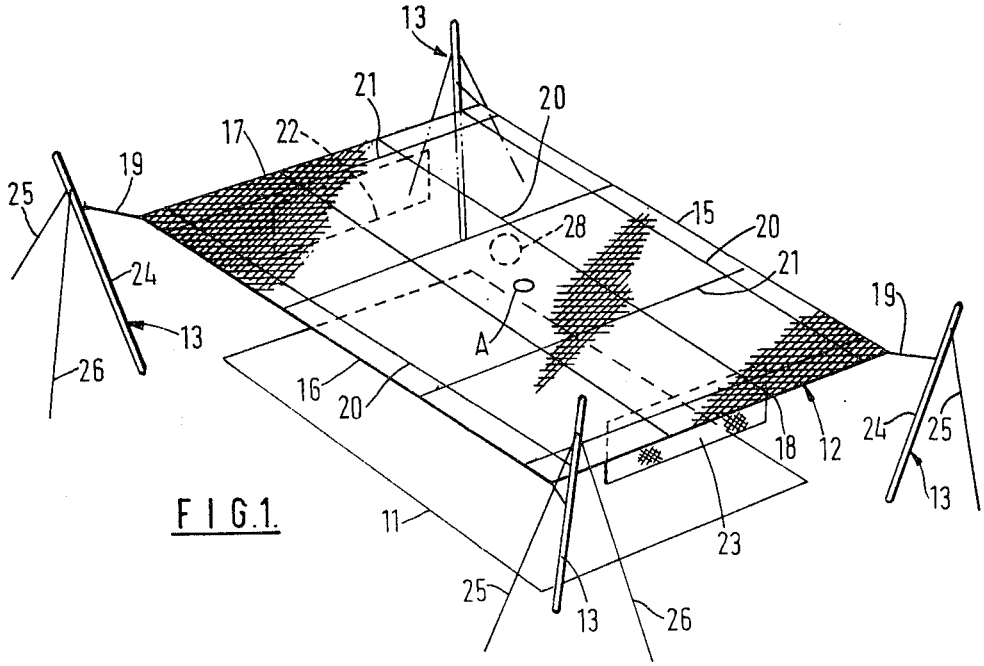

This invention relates to a games apparatus for a game in which two persons, or teams, compete each playing to drive a "ball" into a goal area defended by the other person or team.

Ball games within the above definition are well known in the art and such popular games as football, tennis, rugby, polo, and hockey, are examples of such games. In all such prior art ball games the ball comprises a "heavier than air" ball, that is to say the ball has a total weight greater than the weight of atmospheric air displaced by the ball.

It is also known to cover a playing area with a roof, with side walls, to contain a ball, such as a tennis ball, within a defined volume.

The object of the present invention is to provide a new games apparatus for a new game, the apparatus comprising, in combination, a ball and two goals characterised in that the ball is a lighter-than-air ball and the combination further includes a roof preventing the ball from rising beyond the reach of the players.

By "lighter-than-air" ball the applicant means a gas filled the envelope the total weight of which is less than the weight of atmospheric air displaced by the ball whereupon, when released, the ball will tend to rise.

Preferably the ball comprises a gas filled envelope at least fifty centimeters in diameter, and more preferably, more than one meter in diameter.

Preferably, but not essentially, the roof has a constant height above the playing area at all locations over the playing area.

Preferably the roof is formed of a lightweight material, that is to say a material having low weight per unit area, and conveniently said roof may be formed of a flexible mesh material.

Preferably the roof extends beyond the length and width of the playing area.

Preferably the roof includes depending side and end walls intended to retain the ball beneath the roof.

Preferably the roof is supported by a ground mounted support means externally of the playing area and, conveniently, the roof is adjustable in height.

In a preferred embodiment the roof comprises a large mesh material supported by a flexible wire or cable frame and said frame is supported by props and tensioned by guy ropes.

Each goal may be defined in a vertical plane, conveniently by a rectangular sheet of material hanging from the roof, by a plurality of uprights suspended from the roof with their axes in a common plane, or by two uprights supporting a light beam apparatus and wherein one or more light beams between the uprights are broken when the ball enters between the uprights. With the latter construction there is preferably provided a means for indicating the breaking of one or more light beams. In an alternative arrangement each goal may be defined in a horizontal plane by an area of the roof of different height, conveniently of greater height, from the mean height of the roof above the playing area.

It will now be seen that the game proposed by the present invention differs from all other games in that the ball is lighter than air and maintains contact with the roof for the greater part of each playing period. Thus, the playing area is in fact defined by the roof and, although advantageous in many ways, the actual playing area on the ground need not be marked.

The game may be played by the players making contact with the ball using their hands, heads and upper trunk parts of the body when the roof height allows such head and upper trunk contact. Alternatively the game may be played with bats, poles and the like devices and the ball may be conveniently at an height which prevents physical contact by the players.

Figure 2:
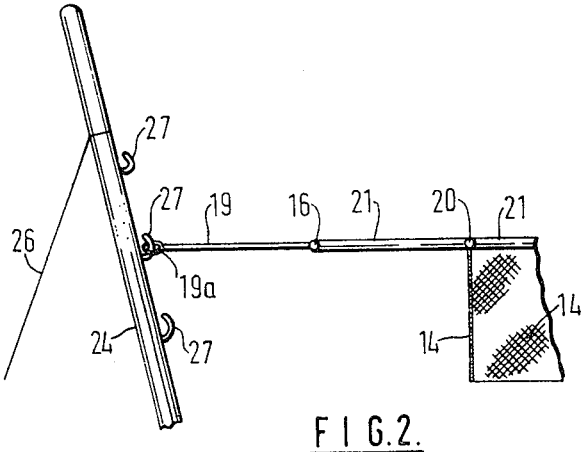
Figure 3:
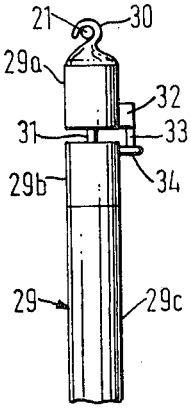

The invention will now be described further by way of example with reference to the accompanying drawings in which:

FIG. 1 shows, in perspective view, one form of games apparatus in accordance with the invention, FIG. 2 shows a horizontal cross-section through a side region of the roof structure of FIG. 1 and, FIG. 3 shows, in enlarged perspective view, a detail of one element of an alternative goal arrangement suitable for use with the apparatus illustrated in FIG. 1.

In FIG. 1 a playing area 11, marked on the ground, is of generally rectangular configuration and a roof 12 is supported by stands 13 so as to cover the playing area 11 and extend for a short distance, for example six feet, beyond each length and width boundary of the playing area 11.

The roof 12 comprises a light weight material, that is to say a material of relatively light weight per unit area, and in the illustrated example the roof 12 comprises a mesh material. As well as covering the playing area, and the boundary regions, the roof includes hanging walls 14 (see FIG. 2) of similar material to the roof, and which conveniently extend downwardly some two or three feet, depending upon the size of the "ball" to be used, to prevent the ball from escaping from beneath the roof. The walls 14 may depend from the periphery of the roof but in the illustrated example said walls 14 are directly above the boundaries of the playing area 11.

The roof 12 is supported by a rectangular wire or cable frame-work comprising two longitudinal members 15 and 16 and two transverse members 17 and 18. Cables 19 at the corners of the rectangular frame present eyelets 19*a* for attachment to the support stands 13.

The roof 12 is further supported by spacedapart intermediate longitudinal cables 20 anchored at their ends to transverse members 17 and 18, and by intermediate spaced apart transverse members 21, each of which has its ends anchored to the members 15 and 16. Thus, when the cables 19 are in tension, the members 15, 16, 17, 18, 20 and 21 are in tension and the roof 12 is in tension and maintains a substantially constant height over the playing area 11. It will be appreciated that some sagging of the roof 12 may occur between adjacent transverse members 21 and adjacent longitudinal members 20 but such sagging is not detrimental to the game and as the ball may well lift the sagging roof areas as said balls rolls thereunder and the ball in such sagging areas may afford special advantages to one or other of the two teams.

The goal areas in the FIG. 1 embodiment are defined by two rectangular panels 22 and 23 of mesh material one at each end of the playing area 11, similar or identical to the material of roof 12, and hanging from transverse members 21. As can be seen from FIG. 2, the lateral extent of goal panels 22 and 23 is of less extent than the end sections of the playing area.

The roof frame 15, 16, 17, 18 is supported by four supports 13 arranged one adjacent each corner of the playing area but outside the playing area 11 so as to leave the playing area clear. Each support 13 comprises an elongate rigid member 24, conveniently of tubular metal, with two guys 25 and 26 attached thereto. The member 24 presents hooks 27 at differently spaced locations from its upper edge and the hooks 27 are selectively engageable with eyelets 19*a*. Thus, by utilizing different hooks 27 of the supports 13, the height of the roof 12 above the playing area 11 can be adjusted as desired.

The roof 12 may be simply erected over any playing area by spreading roof 12 over the playing area 11, locating the lower ends of the rigid members 24 in preset holes or on ground plates, hooking the eyelets 19*a* on selected hooks 27 and then raising the rigid members 24 and tensioning the guys 25 and 26 until the desired tension in roof 12 is attained. Once the roof 12 is tensioned the side walls 14 and goals 22 and 23 may be hung.

Although in the illustrated example the roof is supported by only four supports 13, it will be appreciated that more supports 13 are best provided and, conveniently, a support 13 is provided adjacent each end of each, or selected, longitudinal and transverse members 20 and 21 and connected thereto by a cable 19.

The "ball" 28 comprises a thin-walled envelope conveniently of a tough plastics material, charged with a gas which renders the balloon lighter-than-air so that the balloon rises to the roof within the confines of the side walls 14.

The roof 12 includes a marked area A, directly above the centre of the playing area, and the ball 28 is located directly beneath said marked area at the start of play.

With the apparatus described above two teams, each team comprising two to six players, play the game with the object of pushing the ball 28 to the goal of the opposing team. The ball, being captive beneath the roof, rolls beneath the roof and, upon the ball 28 striking a goal (panel 22 or 23) a "goal" is declared and the ball 28 is returned to the centre location ready for the next play period.

The game may be played by the teams on foot, in which case the roof 12 may be supported by the lowermost hooks 27 of the supports 13, the game may be played by cyclists, in which case the roof 12 will be supported by a suitable level of hooks 27 above the lowermost hooks 27, but the game offers special advantage when played on horseback where a special control of the mount is required and can be practised. When played on horseback the roof 12 is supported from a suitable level of hooks 27 appropriates to the stature of the riders and horses.

The players may engage the ball physically, as by pushing with the hands, or using special implements, such as bats, poles and the like devices, suitably arranged to prevent the ball from being punctured, and to make the game more difficult and interesting for riders (on cycles, ponies or horses) the ball may only be engageable by a rod or staff upstanding from the cycle or the saddle of the rider.

The goal panels 22 or 23 may conveniently be replaced by downwardly hanging elongate members, conveniently of flexible material to avoid injury should a player strike such members, or by a single downwardly depending member, such as the member illustrated in FIG. 3.

The "goal" illustrated in FIG. 3 generally comprises a tubular member 29 in three parts, part 29*a* including a hook 30 by which the goal is attached to a longitudinal member 20 or a transverse member 21, part 29*b* being supported from part 29*a* by a flexible cable 31, which affords a substantially universal displacement of part 29*b* with respect to part 29*a*, and part 29*c*, depending from part 29*b*, and forming the greater part of the length of the member 29, said part 29*c* being made from a flexible resilient tubular material.

One, or a plurality, of micro-switches 32 secured to the part 29*a* present their actuating member 33 to abutments 34 presented by the part 29*b* whilst the axis of the part 29*b* is concentric with the axis of part 29*a*.

With the goal arrangement 29 in use the ball 28, when pressed against the member 29, will cause the axis of the parts 29*b* and 29*c* to be displaced from the concentric location with respect to part 29*a* and therefore the, or a, micro-switch 32 will operate to indicate, conveniently by an alarm, that a goal has been scored.

I claim:

1. A games apparatus comprising, in combination:

(a) a lighter-than-air ball, (b) a substantially planar roof which is such as to permit the ball to run along the underside thereof but not to pass therethrough, said roof being devoid of apertures sized to receive the ball, (c) means for mounting the roof to lie above the ground to define thereunder a playing area having opposite end regions, said mounting means being arranged to maintain the roof at a height above the ground which is such as to permit players to move about on the playing area, (d) means to enable a player to score over an adversary comprising goals to be engaged by the ball; the said goals comprising a single pair of goals respectively disposed in opposite end regions of the playing area and of a surface area substantially less than the area defined between the roof at the respective end of the playing area and the ground therebelow and of a lateral extent less than the lateral dimension of each said end region whereby a player needs to aim the ball to engage it with a goal.

2. A games apparatus, as claimed in claim 1, wherein said ball is a spherical envelope of plastics material charged with a lighter-than-air gas and having a diameter greater than fifty centimeters.

3. A games apparatus, as claimed in claim 1, wherein said roof comprises flexible material with spaced apart flexible support members intended to be in tension when the roof is in use.

4. A games apparatus, as claimed in claim 1, wherein said means for mounting the roof comprises stands adapted to allow the roof to be supported at selected different mean heights.

5. A games apparatus, as claimed in claim 1, wherein said goals are suspended from said roof.

6. A games apparatus, as claimed in claim 1, further comprising flexible side and/or end walls hanging from or adjacent to edges of said roof.

7. A games apparatus, as claimed in claim 1, wherein each said goal includes a sensing device for sensing the ball in a location indicative of a goal scoring location.

* * * * *